US011095025B2

(12) United States Patent
Adugna et al.

(10) Patent No.: US 11,095,025 B2
(45) Date of Patent: Aug. 17, 2021

(54) RADOME WALL FOR COMMUNICATION APPLICATIONS

(71) Applicant: Lufthansa Technik AG, Hamburg (DE)

(72) Inventors: Tobias Adugna, Hamburg (DE); Arno Strotmann, Hamburg (DE)

(73) Assignee: LUFTHANSA TECHNIK AG, Hamburg (DE)

( * ) Notice: Subject to any disclaimer, the term of this patent is extended or adjusted under 35 U.S.C. 154(b) by 125 days.

(21) Appl. No.: 16/344,819

(22) PCT Filed: Oct. 24, 2017

(86) PCT No.: PCT/EP2017/077050
§ 371 (c)(1),
(2) Date: Apr. 25, 2019

(87) PCT Pub. No.: WO2018/077823
PCT Pub. Date: May 3, 2018

(65) Prior Publication Data

US 2020/0058991 A1 Feb. 20, 2020

(30) Foreign Application Priority Data

Oct. 27, 2016 (DE) ..... 10 2016 221 143.9

(51) Int. Cl.
*H01Q 1/42* (2006.01)
*H01Q 1/28* (2006.01)

(52) U.S. Cl.
CPC ..... *H01Q 1/422* (2013.01); *H01Q 1/28* (2013.01)

(58) Field of Classification Search
CPC ..... H01Q 1/422; H01Q 1/28
See application file for complete search history.

(56) References Cited

U.S. PATENT DOCUMENTS

| | | | | |
|---|---|---|---|---|
| 3,002,190 | A | 9/1961 | Oleesky et al. | |
| 5,182,155 | A | 1/1993 | Roe | |
| 5,849,234 | A | 12/1998 | Harrison et al. | |
| 7,420,523 | B1 | 9/2008 | Ziolkowski et al. | |
| 7,463,212 | B1 | 12/2008 | Ziolkowski | |
| 9,123,998 | B1 | 9/2015 | Lore | |
| 2011/0050370 | A1 | 3/2011 | Lee et al. | |
| 2016/0172748 | A1 * | 6/2016 | Keen | H01Q 1/422 343/872 |

FOREIGN PATENT DOCUMENTS

| | | | |
|---|---|---|---|
| EP | 2747202 | A1 | 6/2014 |
| JP | 2009194829 | A * | 8/2009 |
| JP | 4931838 | B2 | 5/2012 |

* cited by examiner

*Primary Examiner* — Dieu Hien T Duong
(74) *Attorney, Agent, or Firm* — Leydig, Voit & Mayer Ltd.

(57) ABSTRACT

A radome wall for communication in a frequency band of from 17 to 31 GHz for use on commercial aircraft includes a multilayer structure having an alternating arrangement of force-absorbing solid cover layers and sheer-rigid core layers. The radome wall includes at least four of the cover layers, of which two form outer sides of the radome wall, the cover layers and the core layers being made of a dielectric material.

8 Claims, 1 Drawing Sheet

RADOME WALL FOR COMMUNICATION APPLICATIONS

CROSS-REFERENCE TO PRIOR APPLICATIONS

This application is a U.S. National Stage Application under 35 U.S.C. § 371 of International Application No. PCT/EP2017/077050 filed on Oct. 24, 2017, and claims benefit to German Patent Application No. DE 10 2016 221 143.9 filed on Oct. 27, 2016. The International Application was published in German on May 3, 2018, as WO 2018/077823 A1 under PCT Article 21(2).

FIELD

The invention relates to a radome wall for communication.

BACKGROUND

In order to protect antennas for the emission and/or reception of electromagnetic radiation against external mechanical or chemical influences, for example wind and rain, protective shells referred to as "radomes" for antennas are known. Besides the structural strength required for protection of the antennas, for radomes it is essential that they have a suitable transmission behavior, i.e. they are to a sufficient extent transparent for electromagnetic radiation in the frequency range relevant for the antenna(s) to be protected—for communication applications, such as data transmission, the frequency range may be for example from 17 to 31 GHz.

Particularly for applications in which the shaping of a radome cannot be arbitrarily freely selected, it is furthermore necessary for the wall of the radome also to have a good transmission behavior in a sufficiently large range of the angle of incidence, starting from orthogonal incidents of the radiation on the wall. One example of such an application is the protection of antennas for satellite communication on commercial aircraft, in the case of which for aerodynamic reasons the radomes must be adapted to the shaping of the skin of the aircraft, although because of this, electromagnetic radiation generally does not orthogonally strike, and pass through, the radomes.

As is summarized for example in EP 2 747 202 A1, radomes consisting of three- or five-sheet sandwich structures comprising GFRC sheets and foam sheets are known, which on the one hand have a sufficient transmission behavior and on the other hand offer sufficient structural strength with low weight. To this end, sheet arrangements suitable for the desired frequency ranges may be calculated, particularly with a view to the thickness of the individual sheets, although the dielectric constants of the individual sheet materials must also be taken into account.

A disadvantage with the state of the art radomes is, however, that the quality of the transmission behavior in the case of an angle of incidence deviating from an orthogonal incidence of the electromagnetic radiation on the radome wall depends strongly on compliance with the previously calculated thicknesses of the individual sheets. Consequently, the manufacturing tolerances in relation to the thicknesses of the individual sheets are very small, which leads to elaborate and expensive production.

SUMMARY

An embodiment of the present invention providers a radome wall for communication in a frequency band of from 17 to 31 GHz for use on commercial aircraft that includes a multilayer structure having an alternating arrangement of force-absorbing solid cover layers and sheer-rigid core layers. The radome wall includes at least four of the cover layers, of which two form outer sides of the radome wall, the cover layers and the core layers being made of a dielectric material.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 2:
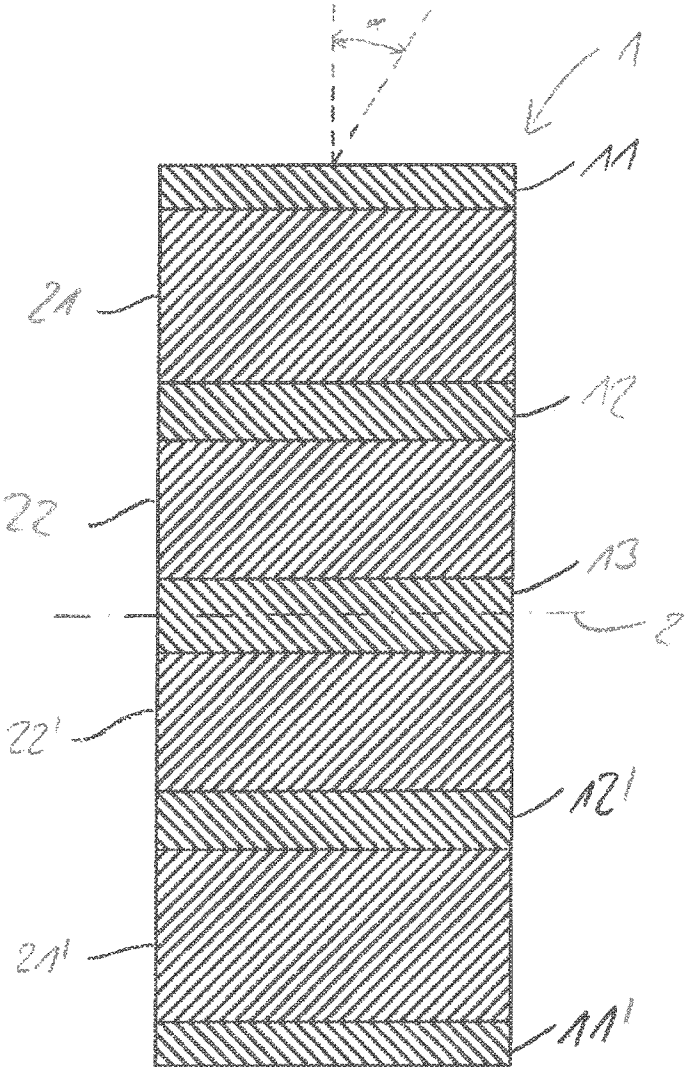
FIG. 2 shows a schematic section through a second exemplary embodiment of a radome wall according to the invention.

Embodiments of the present invention provide a radome wall with which the above-describe disadvantages of state of the art radomes no longer occur, or at least still occur only to a reduced extent.

Embodiments of the present invention provide a radome wall for communication, in particular data transmission, in the frequency band of from 17 to 31 GHz for use on commercial aircraft, including a multilayer structure having an alternating arrangement of force-absorbing solid cover layers and sheer-rigid core layers, where the radome wall includes at least four cover layers, of which two form the outer sides of the radome wall, the cover layers and the core layers being made of dielectric materials.

Embodiments of the present invention further provide a radome for use on commercial aircraft, the wall of which is configured according to the invention.

The radome wall according to embodiments of the present invention is distinguished in that it is formed in sandwich fashion with $n \geq 4$ cover layers and—since the outer sides of the wall are respectively intended to be formed by a cover layer—$n-1$ core layers. The cover layers are also force-absorbing solid layers, which are supported and kept at a distance by merely geometrically stable core layers. In this case, the core layers absorb only a small part of the forces acting on the component in comparison with the cover layers, but under load exhibit only a scarcely noticeable and negligible deformation under operating load (often much less than 1%). In general, the density of the cover layer is greater than the density of the core layers. A high stiffness with at the same time a low weight can be achieved with the aid of a sandwich design.

For use of the sandwich design for radomes, the radome wall is formed in this way has a good transmission behavior. In particular the least possible attenuation, or a high electromagnetic penetrability should be achieved in the frequency range relevant to the antenna protected by the radome over an angle of incidence range which is as large as possible. While such can in principle also be achieved with three- or five-sheet sandwich structures, this however requires high-precision manufacturing. Particularly in relation to the thickness of the individual layers, in the state of the art radomes, it is necessary to comply with very small manufacturing tolerances in order to reliably avoid degradation of the transmission properties.

Embodiments of the present invention are based on the discovery that, in the case of a multilayer structure of the radome wall with at least four cover layers—i.e. an at least seven-sheet sandwich structure—leads to a significantly more tolerant design in relation to minor variations in thickness, without relevant degradation of the relevant transmission properties occurring. Despite the large number of layers, and the associated greater production outlay, the production costs of a radome wall according to the invention can nevertheless be reduced in comparison with a three- or five-sheet design from the state of the art, since the manufacturing tolerances can be selected to be much more generous compared with the state of the art. At the same time, a high overall strength of the radome wall can be achieved, which may correspond at least to that of a three- or five-sheet design. Weight savings compared with the prior art are generally also possible.

By suitable selection of the thicknesses of the individual cover and core layers—while taking into account the respective dielectric constants—optimal thicknesses for the individual layers for the desired frequency range, with which good electromagnetic transmission properties can be achieved in the desired frequency range, can be determined by simple parameter studies known per se to the person skilled in the art. In this case, the good transmission properties over a large angle range of from 0° up to about 65°, respectively in terms of the surface normal of the outer side of the radome wall at the position where the electromagnetic radiation is incident. This is advantageous in particular for radomes of antennas for satellite communication on board commercial aircraft, which generally operate in the frequency range of from 17 to 31 GHz. It is thus possible to configure the radome aerodynamically favorably as part of the outer skin of the aircraft, without incurring a significant bandwidth loss. Thus, fuselage- and empennage-mounted antennas for broadband satellite data transmission can be produced.

It is preferred for the radome wall to be area-symmetrical with respect to the midplane of the radome wall. The symmetrical structure ensures that there are the same good transmission properties both for transmission and for reception of signals by the antenna protected by the radome wall.

It is furthermore preferred for the two core layers closest to the outer sides of the radome wall to be thicker than the core layer(s) closest to the midplane of the radome wall. By a corresponding configuration of the layers, the good transmittance is in particular ensured over a wide angle of incidence range (for example from 0° to 65°).

The tolerance for the thickness of the cover layers for a rated thickness of up to 1 mm may be ±30%, preferably ±20%, and for a rated thickness of more than 1 mm may be ±0.3 mm, more preferably ±0.2 mm. The tolerance for the core layers is preferably ±0.4 mm, more preferably ±0.3 mm, more preferably ±0.2 mm. Corresponding tolerances can be achieved during the production of a radome wall according to the invention without elaborate and expensive manufacturing methods being required therefor.

In one preferred embodiment, four cover layers and three core layers are provided, the material thicknesses of which are, in order, preferably 0.42 mm (cover layer), 2.00 mm (core layer), 0.21 mm (cover layer), 1.00 mm (core layer), 0.21 mm (cover layer), 2.00 mm (core layer), 0.42 mm (cover layer). These material thicknesses may of course be provided with the tolerances mentioned above.

In an alternative preferred embodiment five cover layers and four core layers are provided, the material thicknesses of which are, in order, preferably 0.63 mm (cover layer), 2.50 mm (core layer), 0.84 mm (cover layer), 2.00 mm (core layer), 1.06 mm (cover layer), 2.00 mm (core layer), 0.84 mm (cover layer), 2.50 mm (core layer), 0.63 mm (cover layer). In this case as well, the aforementioned tolerances may be provided.

Both preferred embodiments exhibit very good transmission properties for an angle of incidence range of from 0° to 65°, it being possible to establish the frequency range for the good transmission properties substantially by means of the dielectric constants of the material used for the cover layer and the core layer. Determination of the required dielectric constants for achieving the desired frequency range is readily possible for the person skilled in the art. It is in this case preferred for the dielectric constant of the cover layers to be greater than the dielectric constant of the core layers.

For a frequency range of from 17 GHz to 31° Ghz, the dielectric constant of the cover layers is preferably between 2.8 and 4.0, more preferably between 3.0 and 3.6. The dielectric constant of the core layers is preferably between 1.0 and 1.4, more preferably between 1.0 and 1.2.

The cover layers are preferably respectively formed by one or more sheets of prepreg material, preferably quartz glass fiber/epoxy resin prepreg. This may in particular be a quartz fiber fabric preimpregnated with resin, the resin preferably being thermosetting, more preferably an epoxy resin. The use of polyester resin is likewise possible. The thickness of an individual prepreg is in this case preferably 0.21 mm. With a corresponding prepreg, the thicknesses of the individual cover layers of the preferred embodiments can be readily achieved.

The core layers are preferably respectively formed by foam material, preferably from a polyimide hard foam. In this way, a particularly low density of the radome wall is possible. By suitable selection of the foam material, the required geometrical stability and the dielectric permeability can be ensured. Preferably, a homogeneous surface may be produced with the foam material, which allows large-area connection to the cover layer lying above.

The radome according to the invention is distinguished from state of the art radomes by the configuration of the radome wall. For explanation of the radome according to the invention, reference is therefore made to the comments above.

The invention will now be described by way of example with the aid of advantageous embodiments with reference to the appended drawings.

Figure 1:
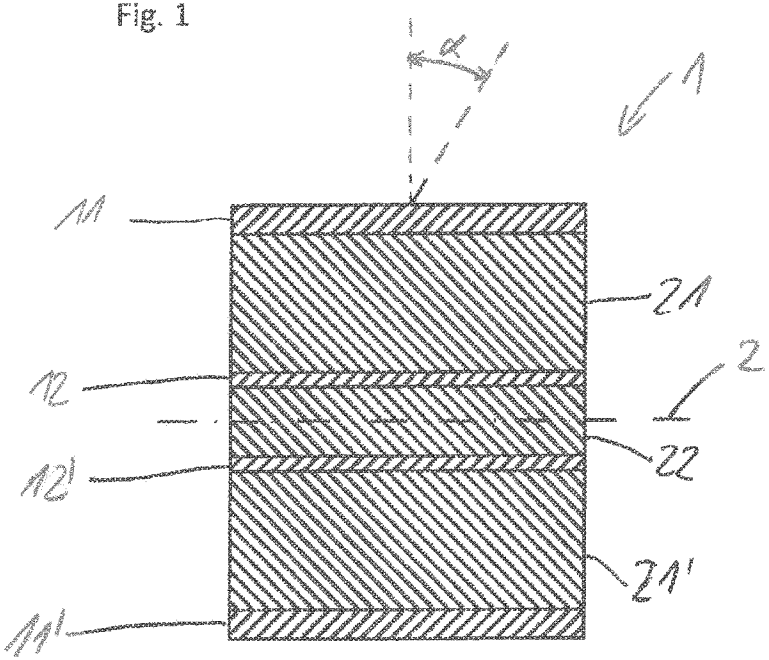
FIG. 1 shows a schematic section through a first exemplary embodiment of a radome wall according to the invention.

FIG. 1 represents a first exemplary embodiment of a radome wall 1 according to the invention for communication, in particular data transmission, in the frequency band of from 17 to 31 GHz for use on commercial aircraft in a sectional view.

The radome wall 1 includes four cover layers 11, 12, 12', 11' and three core layers 21, 22, 21'. The cover layers 11 and 11' in this case respectively form an outer side of the radome wall 1, while the core layers 21, 22, 21' are respectively arranged between two cover layers 11, 12, 12', 11'.

The cover layers 11, 12, 12', 11' are formed from quartz glass fiber/epoxy resin prepreg, the thickness of an individual prepreg sheet being 0.21 mm and the thicknesses of the cover layers 11, 12, 12', 11' in each case exclusively being a multiple thereof.

The core layers 21, 22, 21' are formed from foam material, namely from a polyimide hard foam.

The radome wall 1 is constructed area-symmetrically with respect to the midplane 2, the two core layers 21, 21' closest to the outer sides of the radome wall 1 being thicker than the core layer 22 lying in the midplane 2 of the radome wall 1.

The thicknesses of the individual cover 11, 12, 12', 11' and core layers 21, 22, 21', as well as their respective dielectric constants, may be found in the table below:

| Layer | Thicknesses | Dielectric constant |
|---|---|---|
| 11 | 0.42 mm | 3.3 |
| 21 | 2.00 mm | 1.2 |
| 12 | 0.21 mm | 3.3 |
| 22 | 1.00 mm | 1.2 |
| 12' | 0.21 mm | 3.3 |
| 21' | 2.00 mm | 1.2 |
| 11' | 0.42 mm | 3.3 |

For the aforementioned thicknesses of the cover layers 11, 12, 12', 11', a tolerance of ±20% is provided. For the thicknesses of the core layers 21, 22, 21', the tolerance is ±0.2 mm.

Despite the relatively large tolerances, the radome wall 1 represented has very good transmission properties for a frequency range of from 17 to 31 GHz at an arbitrary angle of incidence a of between 0° to 65°.

FIG. 2 shows a schematic sectional representation of a second exemplary embodiment of a radome wall 1 according to the invention, which is likewise configured for communication, or data transmission, in the frequency band of from 17 to 31 GHz for use on commercial aircraft.

The radome wall 1 includes five cover layers 11, 12, 13, 12', 11' and in order four core layers 21, 22, 22', 21'. The cover layers 11 and 11' in this case again respectively form an outer side of the radome wall 1. The arrangement of the other layers 12, 13, 12', 21, 22, 22', 21' may be found in FIG. 2. The cover 11, 12, 13, 12', 11' and core layers 21, 22, 22', 21' are constructed in a similar way to the exemplary embodiment according to FIG. 1.

The radome wall 1 according to FIG. 2 is also constructed area-symmetrically with respect to the midplane Z, the two core layers 21, 21' closest to the outer sides of the radome wall 1 being thicker than the core layers 22, 22' next to the midplane 2 of the radome wall 1.

The thicknesses of the individual cover 11, 12, 13, 12', 11' and core layers 21, 22, 22', 21', as well as the respective dielectric constants, may be found in the table below:

| Layer | Thicknesses | Dielectric constant |
|---|---|---|
| 11 | 0.63 mm | 3.3 |
| 21 | 2.50 mm | 1.2 |
| 12 | 0.84 mm | 3.3 |
| 22 | 2.00 mm | 1.2 |
| 13 | 1.06 mm | 3.3 |
| 22' | 2.00 mm | 1.2 |
| 12' | 0.84 mm | 3.3 |
| 21' | 2.50 mm | 1.2 |
| 11' | 0.63 mm | 3.3 |

For the aforementioned thicknesses of the cover layers 11, 12, 12', 11', a tolerance of ±20% is provided. For the thicknesses of the core layers 21, 22, 22', 21' and for the thickness of the cover layer 13, the tolerance is ±0.2 mm.

The radome wall 1 represented in FIG. 2 also has very good transmission properties for a frequency range of from 17 to 31 GHz at an arbitrary angle of incidence a of between 0° to 65°.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A radome wall for communication in a frequency band of from 17 GHz to 31 GHz for use on commercial aircraft, comprising a multilayer structure having an alternating arrangement of force-absorbing solid cover layers and sheer-rigid core layers, wherein two of the cover layers form outer sides of the radome wall, the cover layers and the core layers being made of a dielectric material, wherein two core layers of the core layers closest to the outer sides of the radome wall are thicker than at least one of the core layers closest to a midplane of the radome wall, wherein four of the cover layers and three of the core layers are provided, a material thicknesses of which are, in order, 0.42 mm, 2.00 mm, 0.21 mm, 1.00 mm, 0.21 mm, 2.00 mm, 0.42 mm, wherein a tolerance for the material thickness of each of the cover layers for a rated thickness of up to 1 mm is ±20%, and for a rated thickness of more than 1 mm is ±0.2 mm, wherein a tolerance for the material thickness of each of the core layers is 0.2 mm, wherein a dielectric constant of the cover layers is between 3.0 and 3.6, and wherein a dielectric constant of the core layers is between 1.0 and 1.2.

2. The radome wall as claimed in claim 1, wherein the radome wall is area-symmetrical with respect to a midplane of the radome wall.

3. The radome wall as claimed in claim 1, wherein each of the cover layers is respectively formed by one or more sheets of prepreg material.

4. The radome wall as claimed in claim 3, wherein the prepreg material, is quartz glass fiber/epoxy resin prepreg.

5. The radome wall as claimed in claim 4, wherein a thickness of the prepreg material is 0.21 mm.

6. The radome wall as claimed in claim 1, wherein each of the core layers is respectively formed by foam material.

7. The radome wall as claimed in claim 6, wherein foam material is a polyimide hard foam.

8. A radome for use on commercial aircraft, wherein the wall of the radome is configured as claimed in claim 1.

* * * * *